US010343414B2

(12) United States Patent
Ishikawa et al.

(10) Patent No.: US 10,343,414 B2
(45) Date of Patent: Jul. 9, 2019

(54) LIQUID CIRCULATION DEVICE, LIQUID DISCHARGE DEVICE AND LIQUID DISCHARGE METHOD

(71) Applicant: TOSHIBA TEC KABUSHIKI KAISHA, Shinagawa-ku, Tokyo (JP)

(72) Inventors: Hiroyuki Ishikawa, Shizuoka (JP); Kazuhiko Ohtsu, Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 15 days.

(21) Appl. No.: 15/964,176

(22) Filed: Apr. 27, 2018

(65) Prior Publication Data

US 2018/0244068 A1 Aug. 30, 2018

Related U.S. Application Data

(62) Division of application No. 15/088,594, filed on Apr. 1, 2016, now Pat. No. 9,987,853.

(30) Foreign Application Priority Data

Apr. 3, 2015 (JP) ..... 2015-076790

(51) Int. Cl.
*B41J 2/175* (2006.01)
*B41J 2/18* (2006.01)
(Continued)

(52) U.S. Cl.
CPC ..... *B41J 2/18* (2013.01); *B41J 2/1433* (2013.01); *B41J 2/14233* (2013.01); *B41J 2/175* (2013.01);
(Continued)

(58) Field of Classification Search
CPC .... B41J 2/175; B41J 2/17513; B41J 2/17566; B41J 2/14233; B41J 2/1433; B41J 2/18;
(Continued)

(56) References Cited

U.S. PATENT DOCUMENTS 8,727,465 B2 5/2014 Tokuno
2007/0252860 A1 11/2007 Nitta et al.
(Continued)

FOREIGN PATENT DOCUMENTS

JP 2010-017926 1/2010
JP 2010-228099 10/2010
(Continued)

OTHER PUBLICATIONS

Non-Final Office Action for U.S. Appl. No. 15/088,594 dated Mar. 10, 2017, 19 pages.
(Continued)

*Primary Examiner* — Anh T Vo
(74) *Attorney, Agent, or Firm* — Amin, Turocy & Watson LLP

(57) ABSTRACT

A liquid circulation device comprises a liquid chamber connected with a liquid discharge section that discharges liquid, a circulation section which circulates the liquid in a flow path containing the liquid chamber and the liquid discharge section, a liquid supply section, a pressure adjustment section and a control section that, according to fluctuation velocity of the pressure, replenishes the liquid through the liquid supply section if the detected pressure is equal to or smaller than a predetermined pressure value or lower than the predetermined pressure value and the pressure fluctuation velocity is equal to or greater than a predetermined speed or faster than the predetermined speed and adjusts the pressure of the liquid discharge section through the pressure adjustment section and the pressure fluctuation velocity is slower than the predetermined speed or equal to or smaller than the predetermined speed.

6 Claims, 12 Drawing Sheets

(51) Int. Cl.

| | |
|---|---|
| ***B41J 2/14*** | (2006.01) |
| ***B41J 29/38*** | (2006.01) |
| ***B41J 2/185*** | (2006.01) |

(52) U.S. Cl.
CPC ..... *B41J 2/17513* (2013.01); *B41J 2/17566* (2013.01); *B41J 2/185* (2013.01); *B41J 29/38* (2013.01); *B41J 2002/14354* (2013.01); *B41J 2002/1856* (2013.01); *B41J 2202/12* (2013.01)

(58) Field of Classification Search
CPC ..... B41J 2/185; B41J 29/38; B41J 2002/12; B41J 2002/14354
See application file for complete search history.

(56) References Cited

U.S. PATENT DOCUMENTS

| | | | |
|---|---|---|---|
| 2010/0039460 | A1 | 2/2010 | Deleug |
| 2010/0245495 | A1 | 9/2010 | Katada |
| 2011/0226340 | A1 | 9/2011 | Tokuno |
| 2012/0188314 | A1 | 7/2012 | Akiyama et al. |
| 2013/0100199 | A1 | 4/2013 | Suzuki et al. |
| 2014/0118448 | A1 | 5/2014 | Domae |
| 2015/0070415 | A1 | 3/2015 | Ishikawa et al. |
| 2015/0183227 | A1 | 7/2015 | Ishikawa |
| 2016/0059578 | A1 | 3/2016 | Ishikawa |

FOREIGN PATENT DOCUMENTS

| | | |
|---|---|---|
| JP | 2011-051317 | 3/2011 |
| JP | 2011-189701 | 9/2011 |
| JP | 2012-152931 | 8/2012 |
| JP | 2014-087983 | 5/2014 |
| JP | 2015-042498 | 3/2015 |
| JP | 2015-054416 | 3/2015 |

OTHER PUBLICATIONS

Japanese Office Action for Japanese Patent Application No. 2015-076790 dated Dec. 12, 2017.

Japanese Office Action for Japanese Patent Application No. 2017-053375 dated Jan. 23, 2018.

Non-Final Office Action for U.S. Appl. No. 15/607,824 dated Apr. 19, 2018, 28 pages.

Japanese Office Action for Japanese Patent Application No. 2015-076790 dated Apr. 17, 2018.

Final Office Action for U.S. Appl. No. 15/088,594 dated Sep. 7, 2017, 13 pages.

LIQUID CIRCULATION DEVICE, LIQUID DISCHARGE DEVICE AND LIQUID DISCHARGE METHOD

CROSS-REFERENCE TO RELATED APPLICATIONS

This application is a Divisional of application Ser. No. 15/088,594 filed Apr. 1, 2016, the entire contents of which are incorporated herein by reference.

This application is based upon and claims the benefit of priority from Japanese Patent Application No. P2015-076790, filed Apr. 3, 2015, the entire contents of which are incorporated herein by reference.

FIELD

Embodiments described herein relate generally to a liquid circulation device, a liquid discharge device and a liquid discharge method.

BACKGROUND

A liquid discharge device is provided which supplies liquid to a liquid discharge head having a nozzle from a liquid tank and discharges the liquid from the nozzle. The liquid discharge device is a circulation type liquid discharge device that circulates the liquid between the liquid tank and the liquid discharge head. In this kind of the liquid discharge device, bubbles generated in the nozzle of the liquid discharge head and foreign substances mixed in the nozzle can be removed from the vicinity of the nozzle, thereby developing discharge performance. For example, in a case in which it is detected that pressure of a head nozzle is reduced, in order to prevent reduction in the liquid discharge performance, the liquid is supplied, and thus the pressure is increased and adjusted.

DETAILED DESCRIPTION

In accordance with an embodiment, a liquid circulation device comprises a liquid chamber, a circulation section, a liquid supply section, a pressure adjustment section and a control section. The liquid chamber is connected with a liquid discharge section that discharges liquid. The circulation section circulates the liquid in a flow path containing the liquid chamber and the liquid discharge section. The liquid supply section supplies the liquid to the liquid chamber. The pressure adjustment section pressurizes or decompresses gas in the liquid chamber to adjust pressure of the liquid discharge section. The control section, according to fluctuation velocity of the pressure, replenishes the liquid through the liquid supply section in a case in which the detected pressure is equal to or smaller than a predetermined pressure value or lower than the predetermined pressure value and the fluctuation velocity of the pressure is equal to or greater than a predetermined speed or faster than the predetermined speed, and adjusts the pressure of the liquid discharge section through the pressure adjustment section in a case in which the detected pressure is equal to or smaller than the predetermined pressure value or lower than the predetermined pressure value and the fluctuation velocity of the pressure is slower than the predetermined speed or equal to or smaller than the predetermined speed.

Hereinafter, an ink jet recording apparatus 1 according to an embodiment is described with reference to FIG. 1 to FIG. 10. For the sake of describing in each figure, the appropriate structure is expanded, reduced or omitted to be shown.

Figure 1:
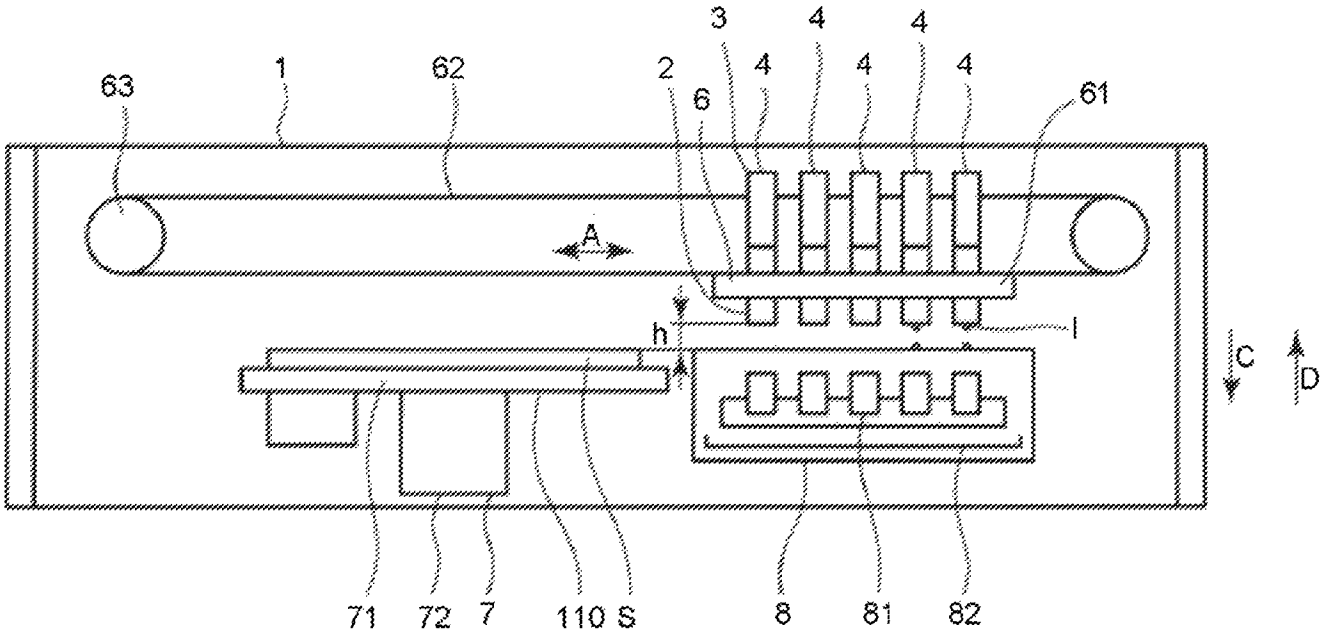
FIG. 1 is a side view of an ink jet recording apparatus according to an embodiment.
Figure 2:
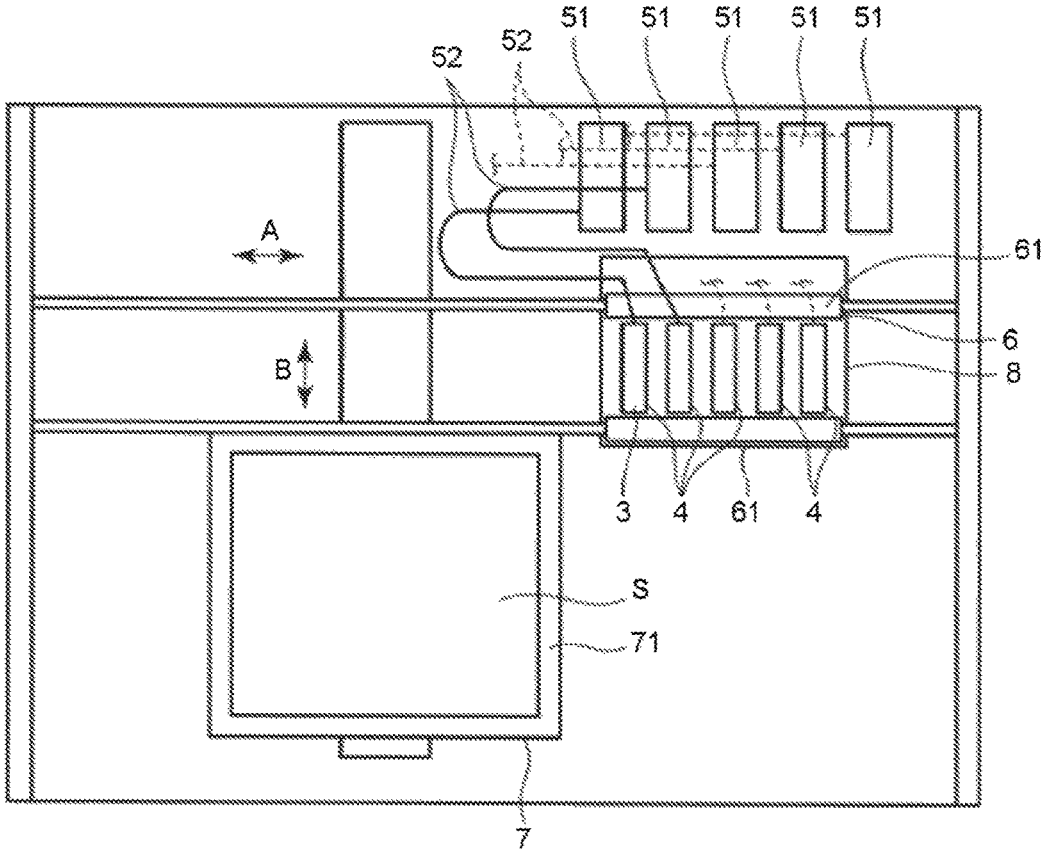
FIG. 2 is a plane view of the ink jet recording apparatus.
Figure 3:
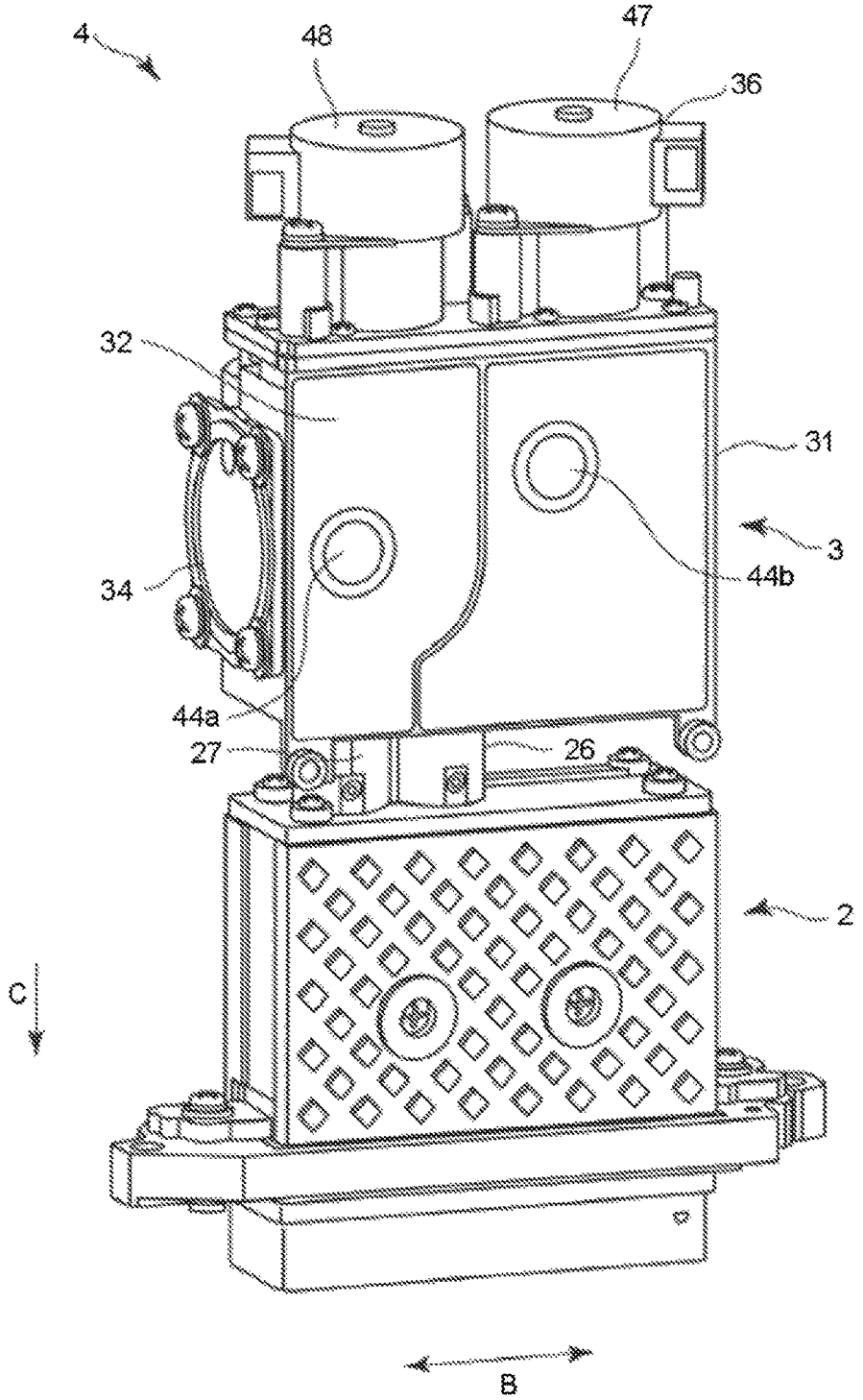
FIG. 3 is a perspective view illustrating the appearance of an ink jet head unit according to the embodiment.
Figure 4:
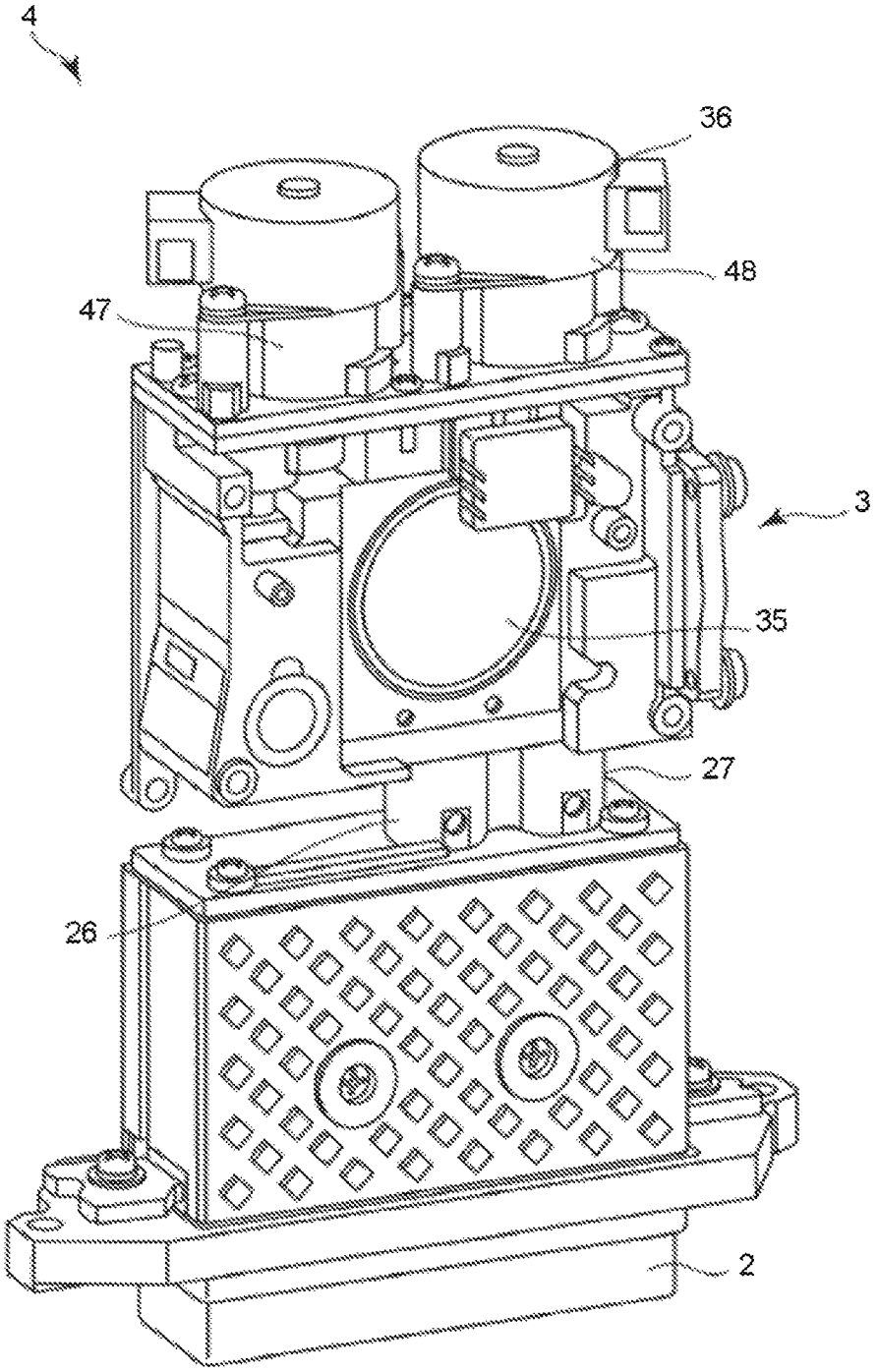
FIG. 4 is a perspective view illustrating the appearance of the ink jet head unit.
Figure 5:
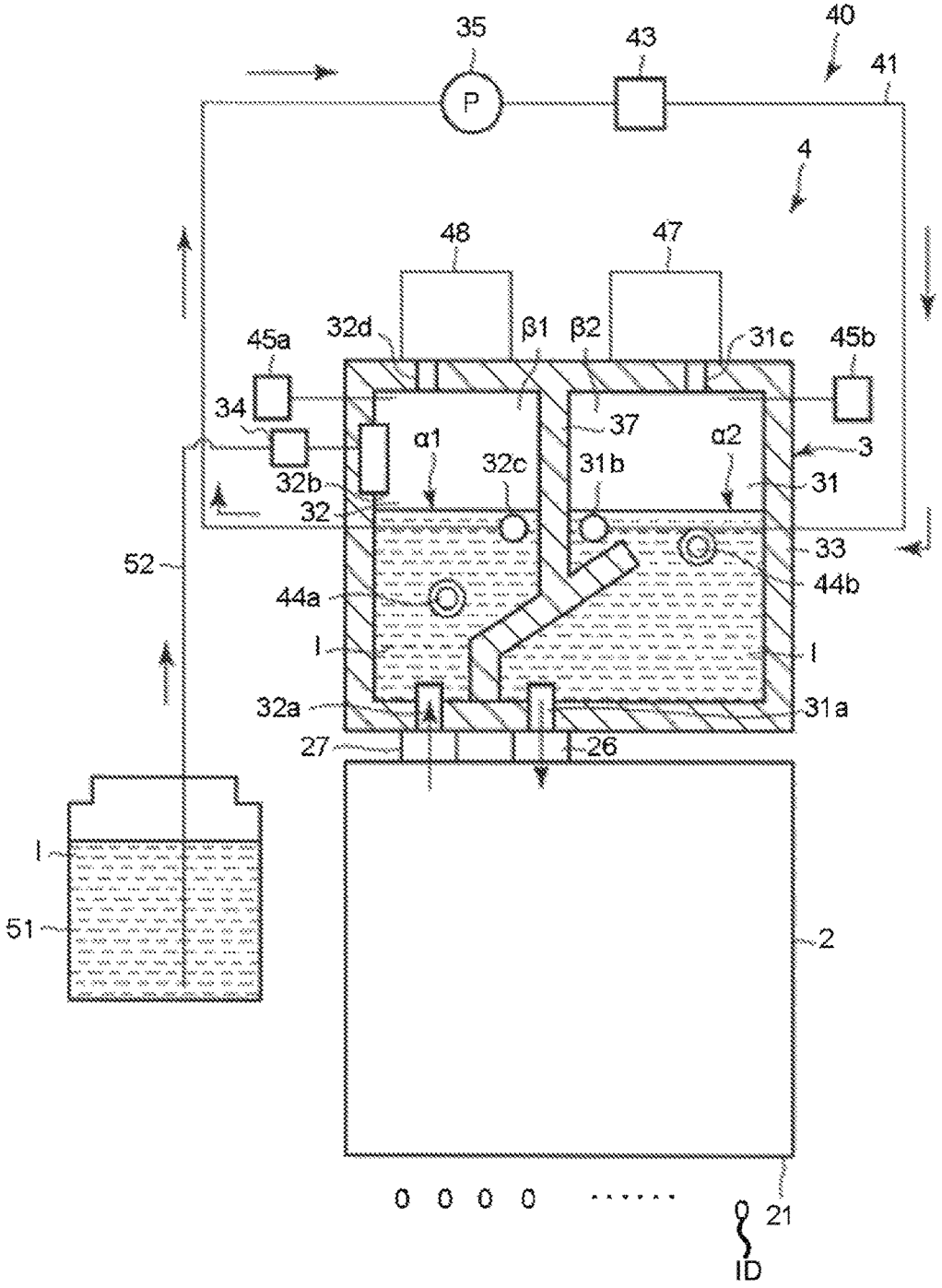
FIG. 5 is an illustration diagram illustrating the flow of liquid in the ink jet recording apparatus.
Figure 6:
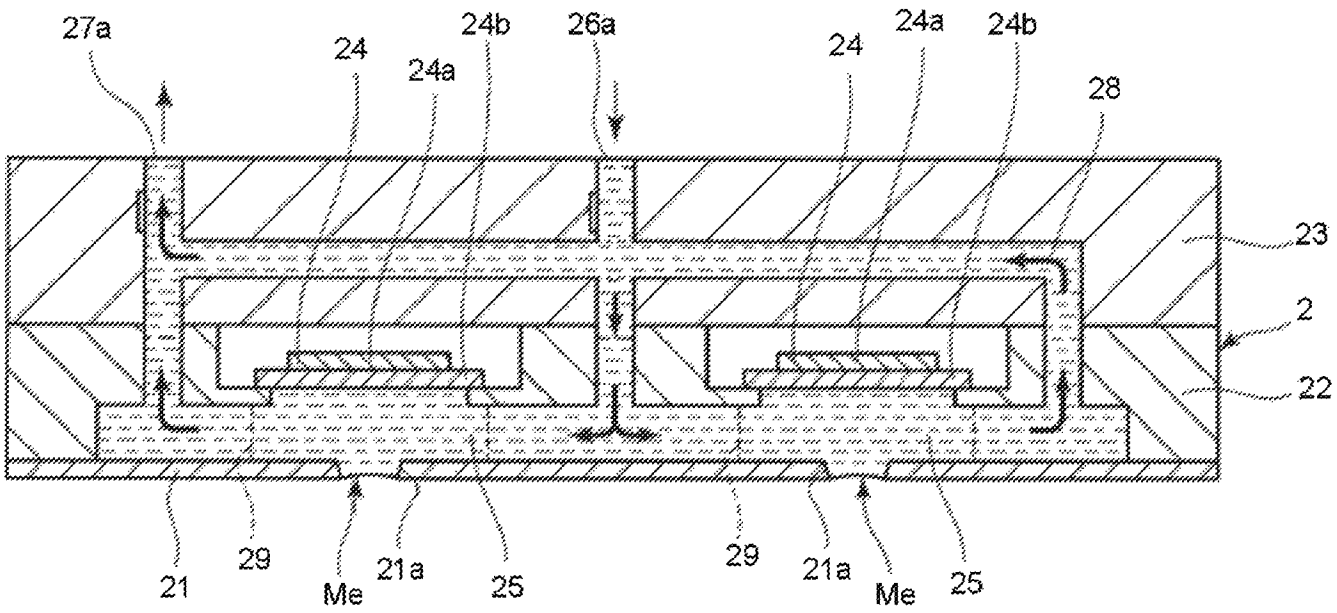
FIG. 6 is a cross-sectional view illustrating the internal structure of an ink jet head.
Figure 7:
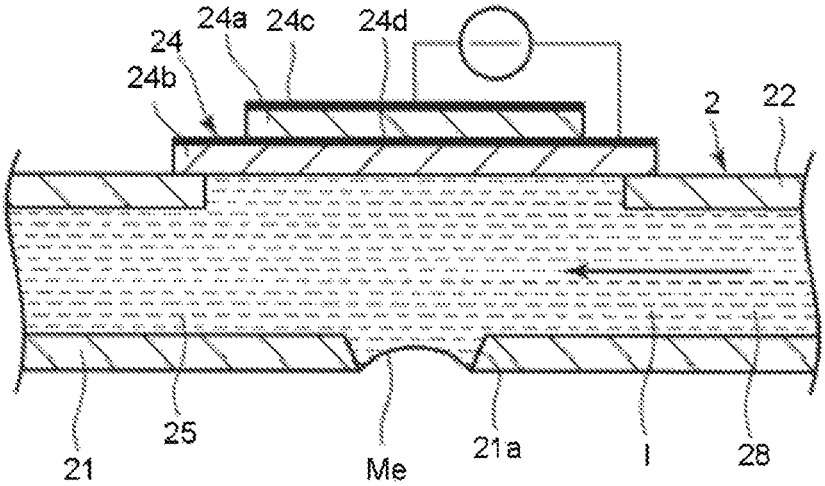
FIG. 7 is an illustration diagram illustrating a state in which ink remains in a nozzle of the ink jet head.
Figure 8:
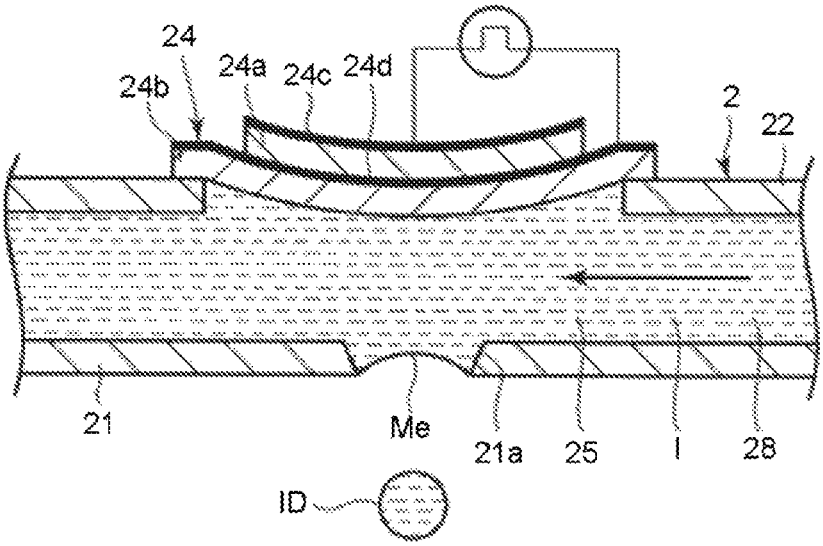
FIG. 8 is an illustration diagram illustrating a state in which an ink droplet is discharged from the nozzle of the ink jet head according to the embodiment.
Figure 9:
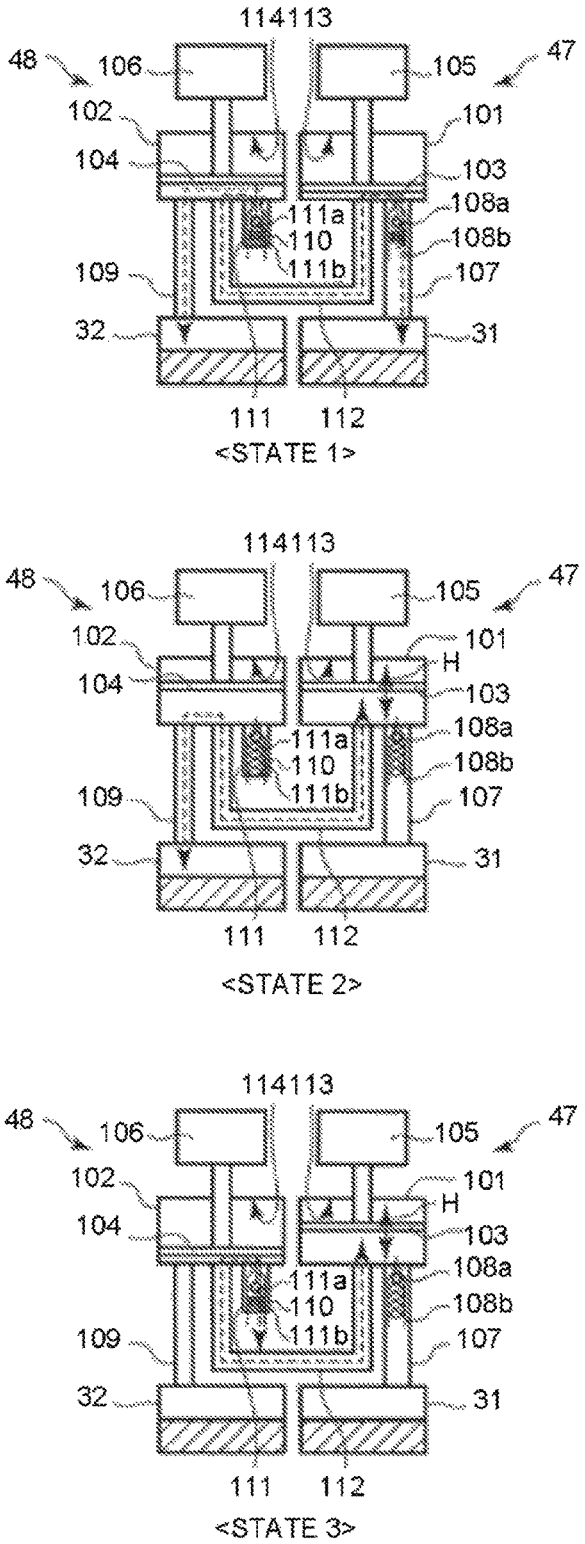
FIG. 9 is an illustration diagram illustrating the structure and operations of a pressure adjustment mechanism of the ink jet head.
Figure 10:
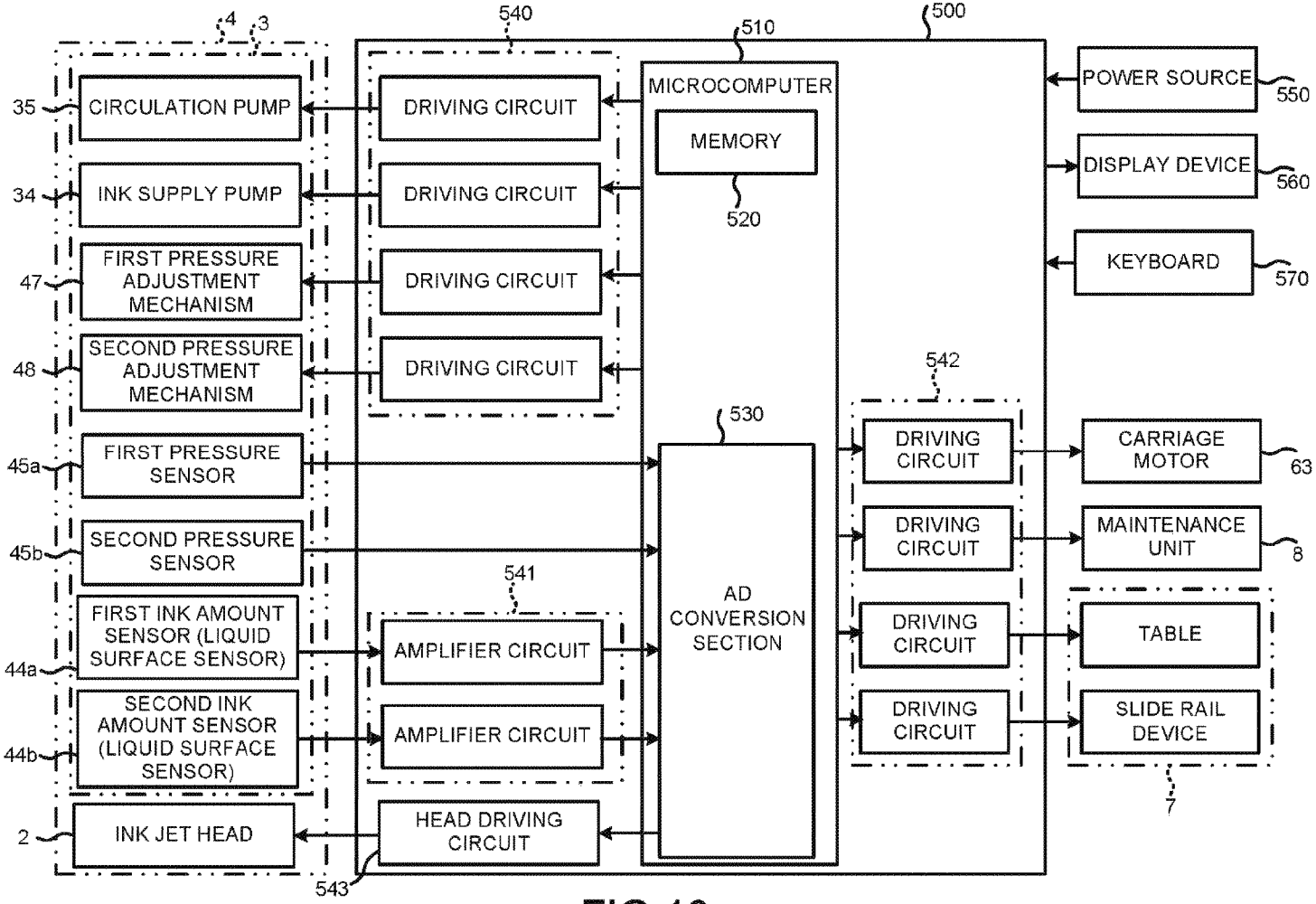
FIG. 10 is a block diagram illustrating a control system of the ink jet recording apparatus according to the embodiment.

FIG. 1 is a side view of the ink jet recording apparatus 1, and FIG. 2 is a plane view of the ink jet recording apparatus 1. FIG. 3 and FIG. 4 are perspective views illustrating the appearance of an ink jet head unit 4, and FIG. 5 is an illustration diagram illustrating the flow of liquid in the ink jet recording apparatus. FIG. 6 is a cross-sectional view illustrating the internal structure of an ink jet head. FIG. 7 and FIG. 8 are illustration diagrams illustrating partial operations of a nozzle of the ink jet head. FIG. 9 is an illustration diagram illustrating the structure and operations of a pressure adjustment section 36. FIG. 10 is a block diagram illustrating a control system of the ink jet recording apparatus.

As shown in FIG. 1 and FIG. 2, the ink jet recording apparatus 1 serving as a liquid discharge device is provided with a plurality of ink jet head units 4 each of which integrally includes an ink jet head 2 serving as a liquid discharge section and an ink circulation device 3, an ink cartridge 5 for holding ink to be supplied to the ink jet head unit, a head supply section 6 for movably supplying the ink jet head unit, an image receiving medium moving section 7 serving as a conveyance section for movably supplying the image receiving medium and a maintenance unit 8.

The ink jet head unit 4 shown in FIG. 3 to FIG. 5 is provided with the ink jet head 2 and the ink circulation device 3 serving as a liquid circulation device integrally arranged on the upper part of the ink jet head 2. For example, cyan ink, magenta ink, yellow ink, black ink and white ink are circulated as liquid and are discharged by a plurality of the ink jet head units 4 to an image receiving medium to form a desired image. Further, color or characteristic of ink used in each ink jet head unit 4 is not limited. For example, instead of the white ink, transparent and glossy ink or special ink that develops a color when irradiated with infrared rays or ultraviolet rays may be discharged. A plurality of the ink jet heads 2 has the same structure though the ink respectively used therein is different. Thus, the plural ink jet heads 2 are described with a common sign.

As shown in FIG. 6, the ink jet head 2 is provided with a nozzle plate 21 having a plurality of nozzles, a substrate 22 which is arranged to face the nozzle plate 21 and includes an actuator 24, and a manifold 23 bonded with the substrate 22.

The nozzle plate 21 includes a first nozzle array and a second nozzle array separately having, for example, 300 nozzles. A predetermined ink flow path 28 inside the ink jet head is formed with the nozzle plate 21, the substrate 22 and the manifold 23.

The substrate 22 that is oppositely bonded with the nozzle plate 21 is constituted into a predetermined shape for forming the predetermined ink flow path 28 containing a plurality of ink pressure chambers 25 located between the nozzle plate 21 and the substrate 22. The substrate 22 includes the actuators 24 at positions facing the ink pressure chambers 25. The substrate 22 includes bulkheads 29 arranged among a plurality of the ink pressure chambers 25 of the same array. The actuator 24 is arranged to face a nozzle hole 21*a*, and the ink pressure chamber 25 is formed between the actuator 24 and the nozzle hole 21*a*.

The manifold 23 is bonded with the upper part of the substrate 22. The manifold 23 includes a supply port 26*a* and an ink discharge port 27*a* communicating with the ink circulation device 3 and is constituted into a predetermined shape for forming the predetermined ink flow path 28 in a state of assembling with the substrate 22 and the nozzle plate 21.

The ink flow path 28 is a path from the supply port 26*a* formed in the manifold 23 to a plurality of the ink pressure chambers 25 communicating with the nozzle holes 21*a* through a common flow path and also from each ink pressure chamber 25 to the ink discharge port 27*a* through the common flow path.

The actuator 24 shown in FIG. 6 to FIG. 8 is composed of a unimorph type piezoelectric vibration plate on which, for example, a piezoelectric element 24*a* and a vibration plate 24*b* are laminated. The piezoelectric element 24*a* is made from, for example, piezoelectric ceramic material such as PZT (Lead Zirconate Titanate) and the like. The vibration plate is formed with, for example, SiN (Silicon Nitride) and the like. As shown in FIG. 7, electrodes 24*c* and 24*d* are arranged at the upper and lower parts of the piezoelectric element 24*a*.

In a case in which no voltage is applied to the electrodes 24*c* and 24*d*, as the piezoelectric element 24*a* is not deformed, the actuator 24 is not deformed either. In a case in which the actuator 24 is not deformed, a meniscus Me serving as an interface of ink I and air is formed in the nozzle hole 21*a* due to surface tension of the ink. The ink I in the ink pressure chamber 25 is held in the nozzle hole 21*a* by means of the meniscus Me.

As shown in FIG. 8, if a voltage (V) is applied to the electrodes 24*c* and 24*d*, the piezoelectric element 24*a* is deformed, and the actuator 24 is deformed as well. Because of the deformation of the actuator 24, pressure applied to the meniscus Me is higher than air pressure (positive pressure), and thus, the ink I becomes an ink droplet ID and then is discharged from the nozzle hole 21*a*. Atmospheric pressure is set to zero, negative pressure is lower than the atmospheric pressure, and the positive pressure is equal to or greater than the atmospheric pressure.

In the ink jet head 2, in a case in which the pressure applied to the meniscus Me in the nozzle hole 21*a* is equal to or greater than the atmospheric pressure (in a case of the positive pressure), the ink I is leaked out from the nozzle hole 21*a*. In a case in which the pressure applied to the meniscus Me is lower than the atmospheric pressure (in a case of the negative pressure), the ink I maintains the meniscus Me and is held in the nozzle hole 21*a*.

For example, if the nozzle hole 21*a* is arranged in such a manner that the ink I is discharged in the gravity direction (downwards), in a case in which the pressure in the ink pressure chamber 25 is equal to or greater than the atmospheric pressure (in a case of the positive pressure), the ink I is leaked out from the nozzle hole 21*a*. Further, in a case in which the pressure in the ink pressure chamber 25 is equal to or smaller than −4.0 kPa, there is a case in which bubbles are sucked from the nozzle hole 21*a* . The mixing of the bubbles may be the reason why the discharge of the ink is failure.

The ink circulation device 3 is provided with an ink casing 33 that includes a supply chamber 31 communicating with the supply port 26*a* of the ink jet head 2 and a collection chamber 32 communicating with the ink discharge port 27*a* therein, a supply pump 34, a circulation pump 35 and a pressure adjustment section 36.

The ink casing 33 includes the supply chamber 31 serving as a liquid chamber which holds the ink I and which supplies the ink I to the ink jet head 2, the collection chamber 32 serving as a liquid chamber which holds the ink I and which collects the ink I from the ink jet head 2, and a common wall 37 between the collection chamber 32 and the supply chamber 31. The ink casing 33 is sealed against outside air.

The supply chamber 31 communicates with the supply port 26*a* of the ink jet head 2 through an ink supply tube 26. An inflow hole 31*b* serving as a passage of ink communicating with a circulation path 41 is formed in the supply chamber 31. Further, a communication hole 31*c* communicating with a communication pipe 107 of a first pressure adjustment mechanism 47 is formed in the supply chamber 31.

The collection chamber 32 communicates with the ink discharge port 27*a* of the ink jet head 2 through an ink return pipe 27. A liquid supplying hole 32*c* is formed in the collection chamber 32. The collection chamber 32 includes a first communication hole 32*d* communicating with the second pressure adjustment section 48 of the pressure adjustment section 36. The collection chamber 32 is connected with an ink cartridge through a tube. Further, a communication hole 32*d* communicating with a communication passage 109 of a second pressure adjustment mechanism 48 is formed in the collection chamber 32.

The supply pump 34 supplies the ink held in the ink cartridge to the collection chamber 32. Further, the supply pump 34 may supply the ink to the supply chamber 31. The supply pump 34 is, for example, a piezoelectric pump. The volume in the supply pump 34 (the volume of a pump chamber) is cyclically changed by bending the piezoelectric vibration plate obtained by bonding the piezoelectric element and a metal plate. The supply pump 34 conveys the ink from the ink cartridge 51 to the pump chamber according to the change of the volume of the pump chamber. The supply pump 34 includes a check valve that regulates the conveyance direction of the ink to only one direction from the ink cartridge 51 to the collection chamber 32. The supply pump 34 supplies the ink from the ink cartridge 51 to the collection chamber 32 through repeating expansion and contraction of the pump chamber.

The ink circulation device 3 includes a circulation section 40. The circulation section 40 comprises a circulation path 41 from the liquid supplying hole 32*c* of the collection chamber 32 to the inflow hole 31*b* of the supply chamber 31, a circulation pump 35 arranged on the circulation path 41 and a filter 43, as shown in FIG. 5. The circulation path 41 is a path from the liquid supplying hole 32*c* of the collection chamber 32 to the inflow hole 31*b* of the supply chamber 31.

The circulation pump 35 is arranged across the adjacent collection chamber 32 and supply chamber 31. The circulation pump 35 circulates the ink I from the collection chamber 32 to the collection chamber 32 via the supply chamber 31 and the ink jet head 2. For example, a tube pump, a diaphragm pump, or a piston pump is used as the circulation pump 35. The circulation pump 35 sucks the ink from the liquid supplying hole 32*c* and supplies the ink I to the supply chamber 31 through the inflow hole 31*b*.

The filter 43 which is located at, for example, the downstream side of the circulation pump 35 on the circulation path 41 in the circulation direction removes a foreign substance mixed into the ink I. For example, a polypropylene mesh filter, a nylon mesh filter, polyphenylene sulfide mesh filter, or a stainless steel mesh filter is used as the filter 43.

While the ink is circulated from the collection chamber 32 to the supply chamber 31 through the circulation section 40, the bubble in the ink I rises in a direction (upwards) opposite to the gravity direction due to buoyancy. The bubble rising due to the buoyancy moves to an air chamber above the liquid surface of the collection chamber 32 or the liquid surface of the supply chamber 31, and then is removed from the ink.

The ink circulation device 3 comprises a first ink amount sensor (liquid surface sensor) 44*a* for measuring ink amount in the collection chamber 32 and a second ink amount sensor (liquid surface sensor) 44*b* for measuring ink amount in the supply chamber 31, as shown in FIG. 5. The first ink amount sensor (liquid surface sensor) 44*a* and the second ink amount sensor (liquid surface sensor) 44*b* vibrate, for example, the piezoelectric vibration plate with an alternating voltage and respectively detect the vibration of the ink transmitting through the collection chamber 32 and the supply chamber 31 to measure the ink amount. No limitations are given to the structure of the ink amount sensor, and the ink amount sensor may be used to measure heights of the first liquid surface $\alpha 1$ and the second liquid surface $\alpha 2$.

The ink circulation device 3 comprises a first pressure sensor 45*a* serving as a pressure detection section for detecting pressure in the collection chamber 32 and a second pressure sensor 45*b* serving as a pressure detection section for detecting pressure in the supply chamber 31. The pressure sensors 45*a* and 45*b* each are, for example, a semiconductor piezoresistive pressure sensor for outputting the pressure as an electrical signal. The semiconductor piezoresistive pressure sensor that includes a diaphragm for receiving pressure from the external and a semiconductor strain gauge formed at the surface of the diaphragm converts the change of electric resistance due to piezoresistive effect generated in the strain gauge into the electrical signal together with the deformation of the diaphragm due to the pressure from the external to detect the pressure.

As shown in FIG. 9, the pressure adjustment section 36 includes the first pressure adjustment mechanism 47 serving as a gas replenishment section and the second pressure adjustment mechanism 48 serving as a gas replenishment section.

The first pressure adjustment section 47 includes a cylinder 101 serving as a first gas chamber communicably connected with the supply chamber 31, a piston 103 that reciprocates in the cylinder 101 and a pulse motor 105 serving as a first volume variable section that enables the piston 103 to reciprocate up and down (in the H direction) and which makes the volume of cylinder 101 changed.

The cylinder 101 has a communication pipe 107 communicating with the supply chamber 31. A first opening and closing section 108 for opening and closing the communication pipe 107 is arranged inside the communication pipe 107. The first opening and closing section 108 comprises an on-off valve 108*a* and a spring 108*b* for energizing the on-off valve 108*a*.

The on-off valve 108*a* is capable of closing the communication pipe 107 communicating the cylinder 101 and the supply chamber 31 through the energization applied by the spring 108*b* and opening the communication pipe 107 through the pressure of the piston 103.

An (I) upper limit position of the piston 103 of the first pressure adjustment section 47 which does not reach a ceiling 113 of the cylinder 101 in the upward direction is arranged by taking a home position as a reference. Further, a (II) communication position at which the first opening and closing section 108 is opened and which communicates with the supply chamber 31 is arranged in the downward direction by taking the home position as the reference. The piston 103 can move to (I) and (II) positions according to an instruction on the predetermined number of pulses and the rotation direction of the pulse motor given by a microcomputer 510.

The second pressure adjustment section 48 includes a cylinder 102 serving as a second gas chamber communicable with the collection chamber 32, a piston 104 arranged in the cylinder 102 and a pulse motor 106 serving as a second volume variable section which enables the piston 104 to move up and down (in the H direction) and which makes the volume of the cylinder 102 changed. The cylinder 102 includes the communication passage 109 communicating with the collection chamber 32 and a communication pipe 110 communicating the inner of the cylinder 102 with the atmosphere. A second opening and closing section 111 for switching the communication state of the collection chamber 32 and the cylinder 102 is arranged inside the communication pipe 110. The second opening and closing section 111 comprises an on-off valve 111*a* and a spring 111*b* for energizing the on-off valve 111*a*. The on-off valve 111*a* is capable of closing a communication hole with the atmosphere through the energization applied by the spring 111*b* and opening the communication hole with the atmosphere through the pressure of the piston 104. Further, in a case in which the piston 104 is located at the bottom of the cylinder 102, it is possible in the second pressure adjustment section 48 that the piston 104 blocks the upper end of the communication passage 109 of the collection chamber 32 and the cylinder 102.

Furthermore, a communication passage 112 for usually communicating the cylinder 101 and the cylinder 102 is arranged between the cylinder 101 of the first pressure adjustment section 47 and the cylinder 102 of the second pressure adjustment section 48.

An (III) upper limit position of the piston 104 of the second pressure adjustment section 48 which does not reach a ceiling 114 of the cylinder 102 in the upward direction is arranged by taking a home position as a reference, and an (IV) atmosphere release position thereof at which the second opening and closing section 111 is opened and a (V) low limit position thereof at which the communication hole with the collection chamber 32 is closed are arranged in the lower part. The piston 104 can move to (III), (IV) and (V) positions according to an instruction on the predetermined number of pulses and the rotation direction of the pulse motor given by the microcomputer 510.

The pressure adjustment section 36 enables the piston 103 in the cylinder 101 of the first pressure adjustment section 47 and the piston 104 in the cylinder 102 of the second pressure adjustment section 48 to reciprocate respectively in the H direction. The reciprocation of the pistons 103 and 104 can change the volume of air in the cylinders 101 and 102 and control the opening and closing of a communication flow path with the atmosphere and communication flow paths of two cylinders 101 and 102. It is possible for the pressure adjustment section 36 to pressurize or decompress the gas in the collection chamber 32 to pressurize or decompress the ink jet head 2 through the change of volume of the air and the opening and closing of the flow paths.

Herein, moving range and positions of the pistons of the pressure adjustment section 36 are described. First, an initial operation of setting the home position is described. If power source is turned on, both of the pistons 103 and 104 move upwards at a predetermined time. Before the power source is turned on, the positions of the pistons 103 and 104 change at point in time when the power source is turned on depending on where the pistons 103 and 104 stop in the cylinders 101 and 102. Thus, when the power source is turned on, the positions of the pistons 103 and 104 in the cylinders 101 and 102 are uncertain.As the positions of the pistons 103 and 104 are uncertain, the pistons 103 and 104 temporarily move to the tops 113 and 114 (ceilings) of the cylinders 101 and 102. Time when the pistons move is assumed as that (initial moving time) taken by the pistons 103 and 104 to move from the bottom positions in the cylinders 101 and 102 to positions at which the pistons 103 and 104 collide with the ceilings 113 and 114. In a case in which the pistons 103 and 104 collide with the ceilings 113 and 114 during the initial moving time when the pistons 103 and 104 move upwards, the pulse motors 105 and 106 step out and stop.

Next, while the pistons 103 and 104 move downwards from the positions at which they collide with the ceilings 113 and 114 to predetermined positions, the predetermined positions are stored as the home positions. Furthermore, in a case in which the pistons 103 and 104 move, the number of moving pulses is counted and the position in the vertical direction is recognized.

The functions of the pressure adjustment section 36 based on the positions of the pistons 103 and 104 in <state 1> of FIG. 9 are described. In the state 1, the piston 104 of the second pressure adjustment section 48 is at the (IV) atmosphere release position, and the piston 103 of the first pressure adjustment section 47 is at the (II) communication position. In this state, as the supply chamber 31 and the collection chamber 32 communicate with each other through the path indicated by dotted line arrows in FIG. 9, both the supply chamber 31 and the collection chamber 32 are in the atmosphere release state and internal pressure is the atmospheric pressure. For example, at the time of the start of use of the inkjet recording apparatus, in a case in which the ink from the ink cartridge 51 is initially filled in the empty ink casing 33, the pressure adjustment section 36 is set to the <state 1>.

The functions of the pressure adjustment section 36 based on the positions of the pistons 103 and 104 in <state 2>of FIG. 9 are described. In the state 2, the piston 104 of the second pressure adjustment section 48 is at a position such as the home position that does not communicate with the atmosphere, and the piston 103 is at the (II) communication position, communicating with the supply chamber 31, at which the first opening and closing section 108 is opened. In the state 2, the collection chamber 32 and the first pressure adjustment section 47 communicate with each other through the path indicated by dotted line arrows in FIG. 9, and the pressure adjustment section 36 enters a sealed state. In the state 2, with the piston 103 of the first pressure adjustment section 47 moving up and down in the arrow H direction, the pressure inside the collection chamber 32 is adjusted. That is, if the piston 103 moves upwards in a range up to the (I) upper limit position, the volume of the air in the cylinder 101 is increased and the pressure in the collection chamber 32 is decreased. On the contrary, if the piston 103 of the first pressure adjustment section 47 moves downwards in a range in which the first opening and closing section is not opened, the volume in the cylinder 101 is decreased and the pressure in the collection chamber 32 is increased.

The functions of the pressure adjustment section 36 based on the positions of the pistons 103 and 104 in <state 3> of FIG. 9 are described. In the state 3, the piston 104 of the second pressure adjustment section 48 is at the (V) low limit position, and the piston 103 is at the (II) communication position, communicating with the supply chamber 31, at which the first opening and closing section 108 is opened. In order to keep the pressure in the collection chamber 32 constant, in a case in which the piston 103 of the first pressure adjustment section 47 moves in the vertical direction, the position at which the piston 103 collides with the ceiling part of the cylinder 101 in the upward direction and the position at which the piston 103 contacts with the first opening and closing section 108 in the downwards direction are in a movable range for the pressure adjustment.

There is a case in which the position of the piston 103 before the adjustment of the pressure is started may beyond the movable range if the piston 103 moves in a direction in which the pressure is adjusted. In this case, the piston 104 of the second pressure adjustment section 48 moves to the (V) low limit position and the collection chamber 32 is sealed, and the first pressure adjustment section 47 is turned into the atmosphere release state and the piston 103 of the first pressure adjustment section 47 is moved to a boundary position in the movable range opposite to the direction in which the pressure is adjusted. The second pressure adjustment section 48 communicates with the atmosphere through the path indicated by the dotted line arrow of FIG. 9, and the move of the piston 103 has no influence on the pressure of the two ink chambers as both the supply chamber 31 and the collection chamber 32 are in the sealed state.

Next, the piston 104 of the second pressure adjustment section 48 moves to the home position, as shown in the <state 2> of FIG. 9, the collection chamber 32 is turned into the sealed state, and the piston 103 of the first pressure adjustment section 47 moves to a direction in which the pressure is adjusted to obtain the predetermined pressure.

As stated above, it is possible that the first pressure adjustment section 47 and the second pressure adjustment section 48 increases or decreases the pressure in the collection chamber 32 and increases or decreases the pressure in the circulation flow path through the operations of the pistons 103 and 104 in the cylinders 101 and 102.

The ink circulation device 3 circulates the ink through the circulation section 40, supplies the ink to the ink jet head 2, and absorbs the bubble or removes the foreign substance contained in the ink I. Further, the ink circulation device 3 adjusts the pressure of the ink pressure chamber 25 and the pressure of the meniscus Me in the nozzle hole 21*a* through the pressure adjustment section 36. For example, in the ink jet recording apparatus 1, by means of the pressure adjustment under the air control and the ink replenishment control, the pressure of the meniscus Me is maintained in a range of −4.0 kPa~atmospheric pressure to prevent unnecessary ink leakage or absorption of bubbles.

The ink cartridge 51 shown in FIG. 2 communicates with the ink circulation device 3 of the ink jet head unit 4 via a tube 52. The ink cartridge 51 is arranged below the ink circulation device 3 in the gravity direction. In the present embodiment, head pressure of the ink in the ink cartridge 51 keeps lower than setting pressure of the collection chamber 32 by arranging the ink cartridge 51 below the ink circulation device 3 in the gravity direction. Only when being driven, the supply pump 34 supplies new ink from the ink cartridge 51 to the collection chamber 32 by arranging the ink cartridge 51 below the ink circulation device 3.

As shown in FIG. 1, the head supply section 6 includes a carriage 61 for supplying the ink jet head unit 4, a conveyance belt 62 for enabling the carriage 61 to reciprocate in an arrow A direction and a carriage motor 63 for driving the conveyance belt 62.

The image receiving medium moving section 7 includes a table 71 for adsorbing and fixing the image receiving medium S. The table 71 is mounted on a slide rail device 72 to reciprocate in an arrow B direction.

The maintenance unit 8 is in a scanning range of the ink jet head unit 4 in the arrow A direction and arranged at a position outside the moving range of the table 71. The maintenance unit 8 is a case of which upper part is opened and is arranged to be removable in the vertical direction (in arrows C and D directions shown in FIG. 1).

The maintenance unit 8 comprises a rubber plate 81 and a waste ink receiving section 82. The rubber plate 81 removes ink, dirt and paper dust adhering to the nozzle plate 21 of the ink jet head 2. The waste ink receiving section 82 receives waste ink, dirt and paper dust generated when a maintenance operation is carried out. The maintenance unit 8 is equipped with a mechanism that enables the plate 81 to move in the arrow B direction and wipes the surface of the nozzle plate 21 with the plate 81.

A control system for controlling the operations of the ink jet recording apparatus 1 is described with reference to a block diagram shown in FIG. 10. The control substrate 500 comprises the microcomputer (micom) 510 serving as a control section for controlling the whole of the ink jet recording apparatus 1, a circulation device driving circuit 540 for driving the ink circulation device 3, an amplifier circuit 541, a moving section driving circuit 542 for driving the image receiving medium moving section 7 and a head driving circuit 543 for driving the ink jet head 2. The ink jet head unit 4 consists of the ink circulation device 3 and the ink jet head 2. The microcomputer 510 includes a memory 520 that stores programs or various kinds of data and an AD conversion section 530 that acquires an output voltage from the ink circulation device 3 of the ink jet head unit 4.

The microcomputer 510 has a function of converting the pressure values detected by the first pressure sensor 45*a* and the second pressure sensor 45*b* through the AD conversion section 530. Further, the microcomputer 510 is possible to calculate a pressure fluctuation velocity V ($\Delta P/\Delta t$) according to a pressure variation value $\Delta P$ that varies during the sampling time $\Delta t$ randomly set by the microcomputer 510.

The control substrate 500 is connected with a power source 550, a display device 560 for displaying the status of the ink jet recording apparatus 1 and a keyboard 570 serving as an input device. The control substrate 500 is connected with driving sections of various pumps and various sensors of the ink jet head unit 4. The control substrate 500 is further connected with the table 71 and the slide rail device 72 of the image receiving medium moving section 7, the driving section of the maintenance unit 8, and the carriage motor 63 of the conveyance belt 62.

Hereinafter, a liquid discharge method of the ink jet recording apparatus 1 is described. In a case in which the ink jet recording apparatus 1 carries out a printing operation initially, the ink I is filled into the ink jet head unit 4 from the ink cartridge 51.

In order to fill the ink I, the microcomputer 510 enables the ink jet head unit 4 to return to a standby position and the maintenance unit 8 to rise in the arrow D direction to cover the nozzle plate 21. The microcomputer 510 drives the supply pump 34 to supply liquid from the ink cartridge 51 to the collection chamber 32. If the ink I in the collection chamber 32 reaches the liquid supplying hole 32*c*, the microcomputer 510 adjusts the pressure of the supply chamber 31 and the collection chamber 32 of the ink casing 33 through the pressure adjustment section 36 and drives the circulation pump 35.

The ink jet recording apparatus 1 respectively initially fills a plurality of the ink jet head units 4 with cyan ink, magenta ink, yellow ink, black ink and white ink in a plurality of the ink cartridges 51.

If the ink I reaches the liquid supplying hole 32*c* of the collection chamber 32 and the inflow hole 31*b* of the supply chamber 31, the microcomputer 510 completes initial filling of the ink I.

In a case in which the initial filling of the ink I is completed, the pressure in the ink casing 33 is maintained at the negative pressure so that no ink I is leaked out from the nozzle hole 21*a* of the ink jet head 2 and no bubble is absorbed from the nozzle hole 21*a*. The meniscus Me in the nozzle hole 21*a* is kept in a negative pressure shape due to the negative pressure of the ink casing 33. Even if the power source 550 of the ink jet recording apparatus 1 is cut off in a state in which the initial filling of the ink I is completed, the ink casing 33 is in a sealed state and the meniscus Me in the nozzle hole 21*a* is kept in a negative pressure shape, thereby preventing the leakage of the ink.

If receiving an instruction of discharge of ink, the microcomputer 510 controls the image receiving medium moving section 7 to adsorb and fix the image receiving medium S on the table 71 and to enable the table 71 to reciprocate in the arrow B direction. The microcomputer 510 moves the maintenance unit 8 in the arrow C direction. Further, the microcomputer 510 controls the carriage motor 63 to convey the carriage 61 in the direction of the image receiving medium S and to enable the carriage 61 to reciprocate in the arrow A direction.

When the ink jet head unit 4 reciprocates along the conveyance belt 62 in the arrow A direction, a distance h between the nozzle plate 21 of the ink jet head 2 and the image receiving medium S is kept constant.

While the ink jet head 2 reciprocates in a direction orthogonal to the conveyance direction of the image receiving medium S, an image is formed on the image receiving medium S. The ink jet head 2 discharges the ink I from the nozzle hole 21*a* arranged on the nozzle plate 21 in response to an image forming signal to form the image on the image receiving medium S.

The microcomputer 510 selectively drives the actuator 24 of the ink jet head 2 and discharges the ink droplet ID on the image receiving medium S from the nozzle hole 21*a* according to an image signal corresponding to image data stored by the memory 520. The microcomputer 510 drives the circulation pump 35. The ink I flowing back from the ink jet head 2 circulates via the collection chamber 32, the filter 43 and the supply chamber 31 and is supplied to the ink jet head 2.

The ink jet recording apparatus 1 removes the bubble and the foreign substance mixed into the ink I through the circulation of the ink I and excellently maintains the ink discharge performance. Thus, the print image quality of the ink jet head unit 4 is improved.

The pressure of the ink casing 33 changes according to the discharge of the ink droplet ID from the nozzle hole 21*a* or the drive of the circulation pump 35. The microcomputer 510 switches between the drive of the pistons 103 and 104 of the pressure adjustment section 36 and the drive of the supply pump 34 to adjust the pressure of the ink casing 33 so as to maintain the pressure of the ink casing 33 in a stable region in which no ink leaks from the nozzle hole 21*a* or no bubble is absorbed from the nozzle hole 21*a*.

For example, if the ink droplet ID is discharged from the nozzle hole 21*a* at the time of the printing, the ink amount of the ink casing 33 is decreased instantaneously and the pressure of the collection chamber 32 is reduced. If the first pressure sensor 45*a* detects the reduction in the pressure of the collection chamber 32, the microcomputer 510 drives the pressure adjustment section 36 or the supply pump 34 according to the detection results of the first pressure sensor 45*a*, the second pressure sensor 45*b*, the first ink amount sensor (liquid surface sensor) 44*a* and the second ink amount sensor (liquid surface sensor) 44*b*.

Figure 11:
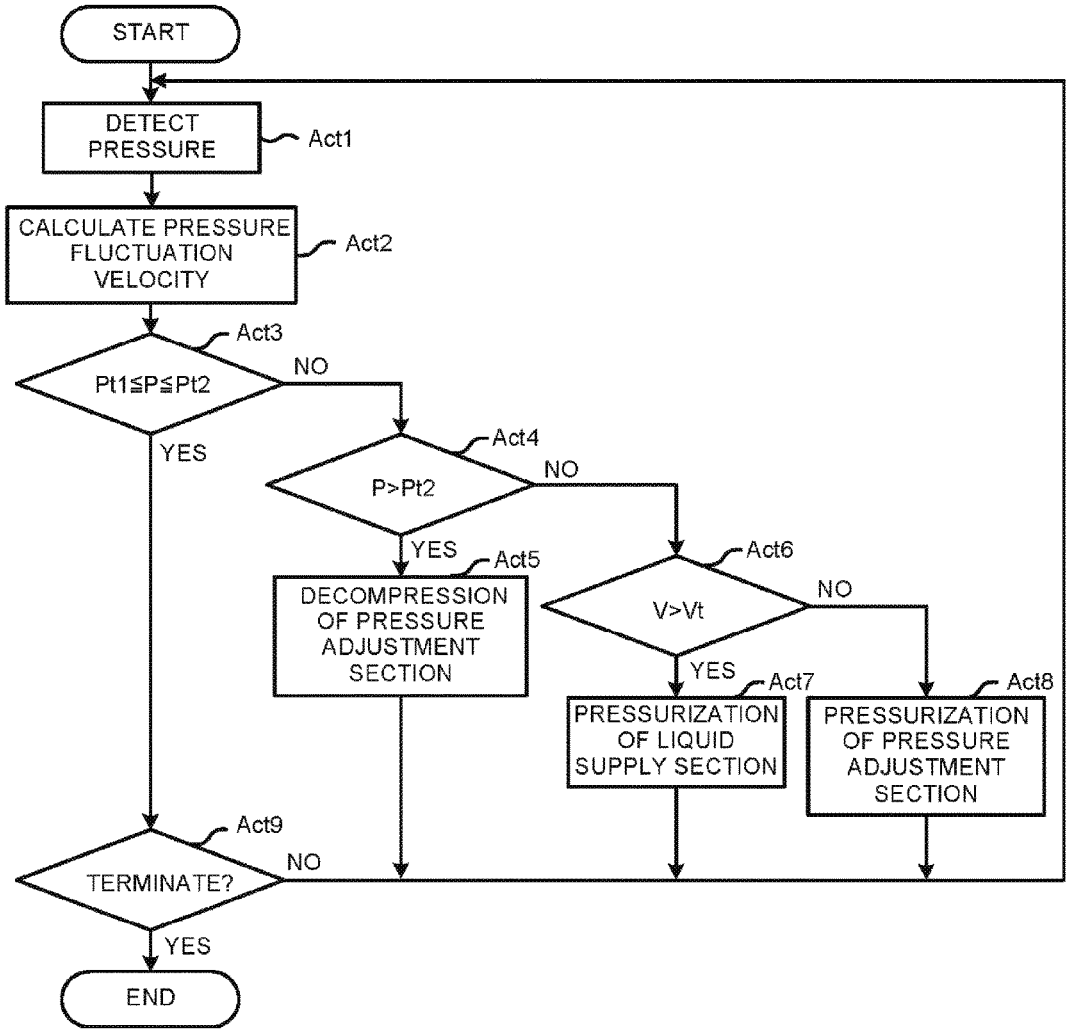
FIG. 11 is a flowchart illustrating a pressure adjustment processing carried out in the ink jet recording apparatus.

A pressure adjustment method for adjusting the pressure applied to the nozzle hole 21*a* is described with reference to FIG. 11 and FIG. 12. FIG. 11 is a flowchart illustrating the pressure adjustment method, and FIG. 12 is a timing chart illustrating a pressure adjustment processing and a graph illustrating a pressure value in a case of carrying out the pressure adjustment processing carried out through the air control and the ink replenishment control.

In ink jet head unit 4, a lower limit value of the stable region of the pressure value P of the nozzle hole 21*a* in which no ink leaks from the nozzle hole 21*a* or no bubble is absorbed from the nozzle hole 21*a* is set to, for example, Pt1 and a upper limit value thereof is set to, for example, Pt2.

Figure 12:
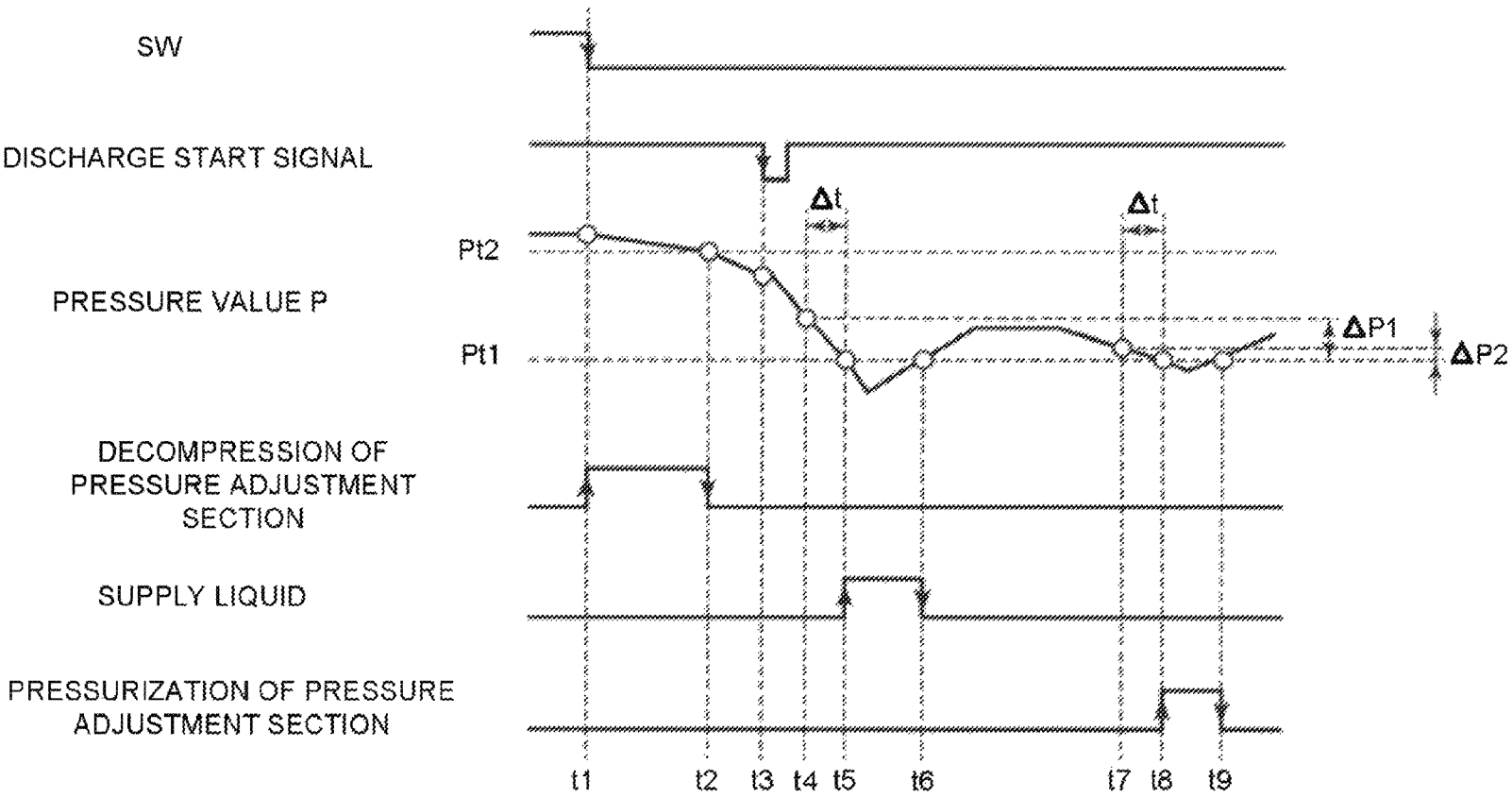
FIG. 12 is a graph illustrating a pressure value in a pressure adjustment process of the ink jet recording apparatus.

As shown in FIG. 11 and FIG. 12, after the power source 550 is turned on at time t1, the pressure value P of the nozzle hole 21*a* is calculated (Act 1) according to the pressure value of the collection chamber 32 detected by the first pressure sensor 45*a* and that of the supply chamber 31 detected by the second pressure sensor 45*b*.

Next, the pressure variation value AP that varies during the random sampling time Δt set by the microcomputer 510 is calculated and moreover the quotient of the ΔP and the Δt is calculated, and then the pressure fluctuation velocity V (ΔP/Δt) is calculated (Act 2).

Then, it is determined whether or not the pressure value P is in the stable region, in other words, whether or not the pressure value P meets an equation "Pt1≤P≤Pt2" (Act3). In a case in which the pressure value P does not meet the equation "Pt1≤P≤Pt2 ", it is determined whether or not the pressure value P exceeds the upper limit value of the stable region, in other words, whether or not the pressure value P meets an equation "P>Pt2 " (Act4). In a case in which the pressure value P does not meet the equations "Pt1≤P≤Pt2 " (No in Act3) and "P>Pt2 " (No in Act4), that is, in a case in which the pressure value P is lower than the lower limit value Pt1, the microcomputer 510 determines whether or not the pressure fluctuation velocity V calculated in Act2 and a pressure fluctuation velocity threshold value Vt set randomly meet an equation "V>Vt" (Act6). For example, the Pt1 is set to 0.8 kPa, and the Pt2 is set to 1.2 kPa.

The Vt is determined by a pressure variation value P1 at the time of the discharge of the liquid and a pressure variation value P2 at the time of the change of the temperature. For example, as to the pressure variation value P1 at the time of the discharge of the liquid, it is assumed that the volume of the ink casing 33 is 100 ml and liquid of 50 ml flows into the ink casing 33. The pressure value in the ink casing at this time is assumed as −1.0 kPa. If it is assumed that liquid of 1 ml is discharged in one second, an equation "P1=−1.02 kPa" is obtained according to the Boyle's law "p1*V1=p2*V2" (p1: pressure value before discharge, V1: amount of air before discharge, p2: pressure value after discharge, V2: amount of air after discharge).

On the other hand, as to the pressure variation value P2 at the time of the change of the temperature, for example, it is assumed that specific heat of the liquid is 4.217 J/K identical to that of water and the liquid is applied with amount of heat of 210.85 J/K that makes the temperature of the liquid of 50 ml increase one degree centigrade in one minute. If the pressure variation value P2 at this time is derived according to Boyle-Charle's law "p*V=nRT" (p: pressure value, V: amount of air, T: temperature, n: amount of substrate, R: gas constant), an equation "P2=0.00067 kPa" is obtained. Thus, in the above-mentioned condition, Vt may be random as long as the pressure variation value in one second makes an equation "P1>P2 " establish. For example, Vt is 0.01 kPa.

In a case in which the equation " V>Vt" is not established, in other words, in a case in which the pressure fluctuation velocity V is smaller than the pressure fluctuation velocity threshold value Vt set randomly (No in Act 6), the microcomputer 510 drives the pressure adjustment section 36 to carry out a pressurization adjustment processing (Act 8).

On the other hand, in a case the equation "V>Vt" is established, in other words, in a case in which the pressure fluctuation velocity V is greater than the pressure fluctuation velocity threshold value Vt set randomly (Yes in Act 6), the microcomputer 510 drives the supply pump 34 to carry out a liquid replenishment operation for replenishing new ink to the ink casing 33 to pressurize the ink casing 33 (Act 7).

That is, a pressure adjustment means of the ink jet head unit 4 is switched among a means using a first pressure adjustment mechanism 47, a means using a second pressure adjustment mechanism 48 and a means using the supply pump 34 according to the relationship between the pressure fluctuation velocity V and the pressure fluctuation velocity threshold value Vt. Herein, there are various reasons such as the change of the temperature, in addition to the change of the pressure caused by the discharge of the ink, as the reason for the change of the pressure of the ink jet head. Thus, in the present embodiment, the replenishment of the liquid and the replenishment of the gas are switched in consideration of the pressure fluctuation velocity. Thus, the liquid can be replenished in a case of the reduction of the pressure caused by the discharge of the ink, and the leakage of the liquid to the outside of a container is avoided by controlling that the liquid is not replenished in a case of the reduction of the pressure caused by the change of the temperature but not the discharge of the ink.

For example, at the time t2 of FIG. 12, if the pressure value P of the nozzle hole 21*a* is in a range from the lower limit value Pt1 to the upper limit value Pt2, in other words, the pressure value P meets the equation "Pt1≤P≤Pt2 " (Yes in Act 3), the microcomputer 510 stops a decompression adjustment processing.

The pressure fluctuation velocity V (ΔP/Δt) is calculated according to the pressure variation value ΔP that varies during the sampling time At set randomly (Act 2). At the time t3 of FIG. 12, a discharge start signal is input from the microcomputer 510 to a head driving circuit 543 and the ink is discharged from the nozzle hole 21*a*, and thus the pressure value P is changed rapidly. Thus, between time t4 and time t5, in a case in which the pressure fluctuation velocity V is greater than the pressure fluctuation velocity threshold value Vt set randomly (Yes in Act 6), and at the time t5, the microcomputer 510 drives the supply pump 34 to replenish the new ink to the ink casing 33 to pressurize the ink casing 33 (Act 7).

At the time t6, if the pressure value P of the nozzle hole 21*a* reaches a range from the lower limit value Pt1 to the upper limit value Pt2 (Yes in Act 3), the microcomputer 510 stops the pressurization adjustment processing.

For example, at the time t7, if the temperature of the atmosphere is reduced, the pressure value P is changed smoothly as the air is reduced. Thus, between the time t7 and time t8, in a case in which the pressure fluctuation velocity V (ΔP/Δt) is smaller than the pressure fluctuation velocity threshold value Vt set randomly (No in Act 6), at the time t8, the microcomputer 510 pressurized the ink casing 33 and carries out a pressurization adjustment processing for the nozzle hole 21*a* through the pressure adjustment section 36 (Act 8).

The foregoing operations (Act1~Act8) is repeated until the pressure adjustment processing is terminated due to, for example, power-off (Act9).

According to the embodiment, in a case in which the pressure fluctuation velocity V is greater than the pressure fluctuation velocity threshold value Vt, the microcomputer 510 drives the supply pump 34 to replenish the new ink to the ink casing 33 to pressurize the ink casing 33. Through setting the pressure fluctuation velocity threshold value Vt to a pressure fluctuation velocity value when random amount of the ink is discharged from the nozzle hole 21*a*, only in a case in which the ink the amount of which is equal to or greater than the specific amount is discharged, the ink is replenished. In other words, in a case in which the negative pressure fluctuation velocity is equal to or greater than a random threshold value, it is determined that the liquid is discharged, and the liquid is supplied to increase the pressure. In a case in which the negative pressure fluctuation velocity is equal to or smaller than the random threshold value, it is determined that the temperature of the atmosphere other than the discharge of the liquid causes the reduction of the pressure, and the air is supplied to carry out the pressurization adjustment processing. That is, by switching between the supply of the liquid and the supply of the air according to whether or not the liquid is discharged, in a case in which the pressure is reduced caused by the temperature of the atmosphere other than the discharge of the ink, the probability that the ink is replenished becomes low. Thus, it is prevented that the liquid in the ink jet head 2 is overflowed in the pressure adjustment processing in a case in which the pressure is reduced caused by a reason other than the discharge of the ink.

The ink jet head unit 4 circulates the ink I through the ink circulation device 3 and removes the bubble or the foreign substance contained in the ink I to keep the ink discharge performance of the ink jet head 2 excellent and improve the print image quantity of the ink jet head unit 4.

Further, the ink jet head unit 4 replenishes the new ink I from the ink cartridge 51 into the ink casing 33 even if the pressure in the printing operation is being adjusted. Thus, the ink jet head unit 4 can replenish the ink I into the ink casing 33 when the pressure P of the nozzle hole 21*a* is adjusted without stopping the printing operation and can prevent the reduction of print production efficiency of the ink jet recording apparatus 1.

Figure 13:
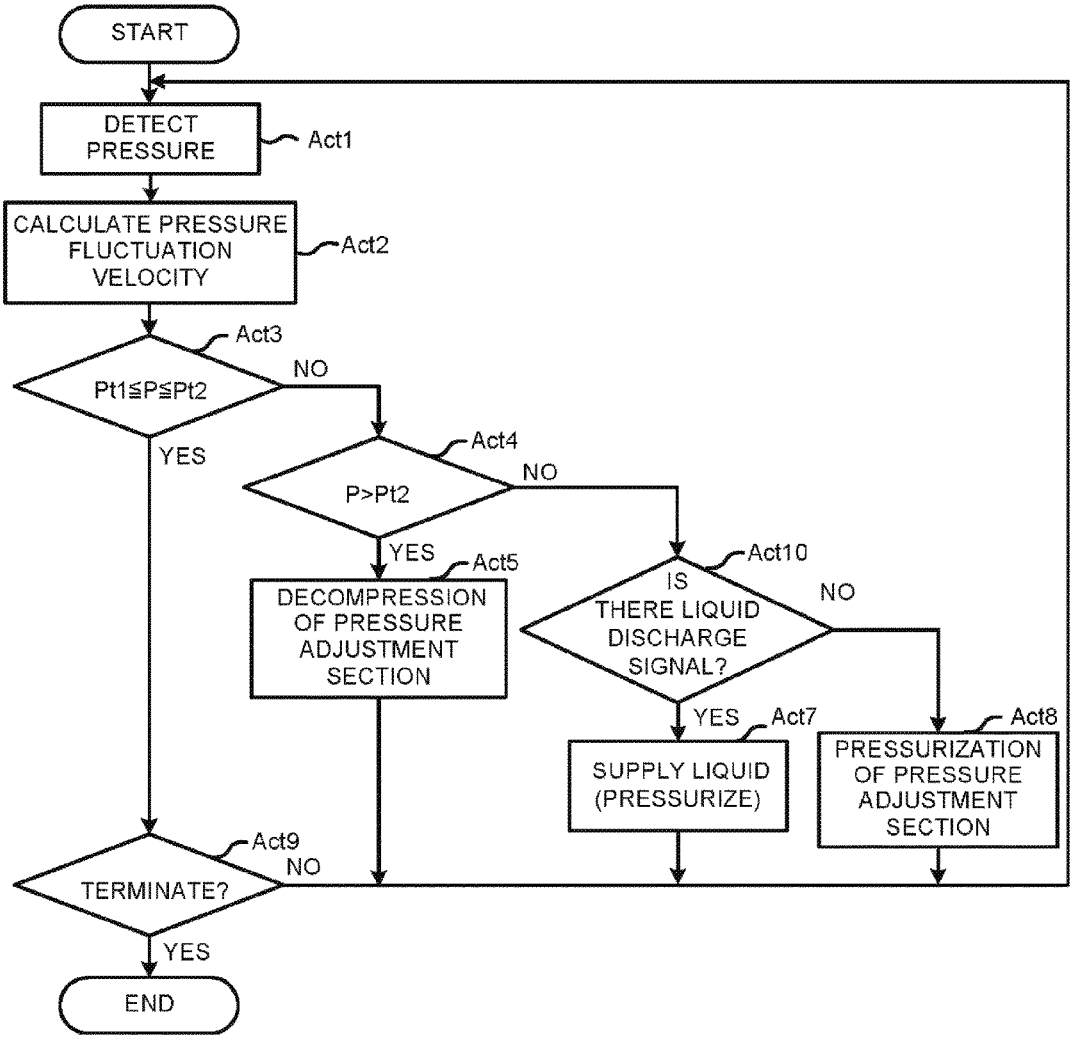
FIG. 13 is a flowchart illustrating a pressure adjustment processing carried out in the ink jet recording apparatus according to another embodiment.

The present invention is not limited to the foregoing embodiment. For example, in FIG. 11, according to the pressure fluctuation velocity V and the pressure fluctuation velocity threshold value Vt, it is determined whether or not the ink is discharged and the means using the pressure adjustment section 36 and the means using the supply pump 34 are switched; however, it is not limited to that. For example, in an ink jet recording apparatus 1 according to another embodiment, as shown in FIG. 13, the microcomputer 510 detects a liquid discharge signal of the ink jet recording apparatus 1. In the ink jet recording apparatus 1 according to the present embodiment, in Act 10 shown in FIG. 13, it is determined whether or not the ink is discharged and the pressure adjustment section 36 and the supply pump 34 are switched according the ink discharge signal output by the microcomputer 510. In this case, the microcomputer 510 arranged in the ink jet recording apparatus functions as a discharge signal detection section.

The structure of the liquid circulation device described above according to the embodiment is not limited. For example, the liquid chamber and the liquid discharge section may not be formed integrally as long as the liquid can be replenished to the liquid chamber and circulated. Further, the liquid circulation device can discharge liquid except the ink. A liquid discharge device that discharges the liquid except the ink may be, for example, a device for discharging the liquid containing conductive particles for forming wiring patterns of a printed wiring substrate.

The ink jet head generates the change of the pressure in the ink in the ink pressure chamber 25; however, the structure thereof is not limited. The ink jet head may be a structure for discharging the ink droplet through the deformation of the vibration plate with, for example, static electricity or a structure for discharging the ink droplet from the nozzle with the use of thermal energy such as a heater. Further, the ink jet head may be includes a temperature sensor to excellently control the discharge of the ink as viscosity of the ink is changed due to the temperature and discharge characteristics thereof from the nozzle is changed.

Further, the structures of the collection chamber 32 and the supply chamber 31 are not limited. For example, the collection chamber 32 and the supply chamber 31 may include a heater for heating the ink to keep the temperature of the ink in a specific range.

The arrangement and the position of the ink cartridge 51 are not limited. For example, in a case in which the ink cartridge 51 is arranged at a position higher than the ink circulation device 3, the water head pressure of the ink in the ink cartridge 51 becomes higher than the setting pressure of the collection chamber 32. In a case in which the ink cartridge 51 is arranged at a position higher than the ink circulation device 3, the ink can be supplied from the ink cartridge 51 to the supply chamber 31 by opening and closing a solenoid valve with the use of water head difference.

Further, the structure of the pressure adjustment section is not limited to the foregoing piston mechanism, and may be, for example, a tube pump or a bellows pump. In this case, the pressure adjustment section supplies the gas to the supply chamber or the collection chamber serving as the liquid chamber or releases the gas from the supply chamber or the collection chamber to carry out a pressure adjustment processing for increasing or decreasing pressure.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A liquid circulation device, comprising:

a liquid chamber configured to be connected with a liquid discharge section that discharges liquid and be capable of holding the liquid;

a circulation section configured to circulate the liquid in a flow path containing the liquid chamber and the liquid discharge section;

a liquid supply section configured to supply the liquid to the liquid chamber;

a pressure sensor configured to detect pressure in the liquid chamber;

a pressure adjustment section configured to pressurize or decompress gas in the liquid chamber to adjust pressure of the liquid discharge section;

a discharge signal detection section configured to detect a liquid discharge signal of the liquid discharge section; and a control section configured to according to the liquid discharge signal, replenish the liquid through the liquid supply section in a case in which the detected pressure is lower than the predetermined pressure value, and the liquid discharge signal is detected, and configured to adjust the pressure of the liquid discharge section by replenishing gas through the pressure adjustment section in a case in which the detected pressure is lower than the predetermined pressure value and no liquid discharge signal is detected.

2. The liquid circulation device according to claim 1, wherein the liquid chamber includes a supply chamber configured to hold liquid supplied to the liquid discharge section and a collection chamber configured to hold liquid collected from the liquid discharge section; and the pressure adjustment section pressurizes or decompresses the collection chamber of the supply chamber by increasing or decreasing the volumes of gas chambers communicating with the collection chamber or the supply chamber.

3. A liquid discharge device, comprising:

a liquid circulation device;

a liquid discharge section including a nozzle for discharging liquid, and being capable of holding the liquid; and a conveyance section configured to convey an image receiving medium to a position at which the liquid is discharged from the nozzle, wherein the liquid circulation device comprises:

a liquid chamber configured to be connected with the liquid discharge section;

a circulation section configured to circulate the liquid in a flow path containing the liquid chamber and the liquid discharge section;

a liquid supply section configured to supply the liquid to the liquid chamber;

a pressure sensor configured to detect pressure in the liquid chamber;

a pressure adjustment section configured to pressurize or decompress gas in the liquid chamber to adjust pressure of the liquid discharge section;

a discharge signal detection section configured to detect a liquid discharge signal of the liquid discharge section; and a control section configured to, according to the liquid discharge signal, replenish the liquid through the liquid supply section in a case in which the detected pressure is lower than a predetermined pressure value, and the liquid discharge signal is detected, and configured to adjust the pressure of the liquid discharge section by replenishing gas through the pressure adjustment section in a case in which the detected pressure is lower than the predetermined pressure value, and no liquid discharge signal is detected.

4. The liquid discharge device according to claim 3, wherein the liquid circulation device is integrally arranged on the liquid discharge section.

5. An ink jet head unit, comprising:

an ink jet head comprising an ink pressure chamber therein and a nozzle hole for discharging liquid;

a supply chamber configured to hold an ink droplet to be supplied to the ink jet head;

a pressure sensor configured to detect pressure in the supply chamber;

a pulse motor configured to apply pressure to the pressure in the supply chamber;

a supply pump configured to supply ink from an ink cartridge to the supply chamber; and a controller configured to:

detect a liquid discharge signal of the ink jet head; and according to the liquid discharge signal, replenish the liquid by driving the supply pump in a case in which the detected pressure is lower than a predetermined pressure value, and the liquid discharge signal is detected, and replenish gas by the pulse motor in a case in which the detected pressure is lower than the predetermined pressure value, and no liquid discharge signal is detected.

6. The ink jet head unit according to claim 5, wherein the predetermined value is a lower limit value of a stable region of a pressure value of the nozzle hole.

* * * * *